US007384717B2

(12) United States Patent
Dinh et al.

(10) Patent No.: US 7,384,717 B2
(45) Date of Patent: Jun. 10, 2008

(54) PHOTORECEPTOR WITH IMPROVED OVERCOAT LAYER

(75) Inventors: Kenny-Tuan T Dinh, Webster, NY (US); John F Yanus, Webster, NY (US); Kendra M Giza, Webster, NY (US); James R Backus, Rochester, NY (US); T Edwin Freeman, Woodstock, GA (US); Markus R Silvestri, Fairport, NY (US); Michael L Mehan, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 361 days.

(21) Appl. No.: 11/234,275

(22) Filed: Sep. 26, 2005

(65) Prior Publication Data

US 2007/0072101 A1 Mar. 29, 2007

(51) Int. Cl.
*G03G 5/147* (2006.01)

(52) U.S. Cl. ..... 430/66; 430/132

(58) Field of Classification Search ..... 430/66, 430/132

See application file for complete search history.

(56) References Cited

U.S. PATENT DOCUMENTS 3,121,006 A 2/1964 Middleton et al.
4,050,935 A 9/1977 Limburg et al.
4,281,054 A 7/1981 Horgan et al.
4,297,425 A 10/1981 Pai et al.
4,298,697 A 11/1981 Baczec et al.
4,338,390 A 7/1982 Lu
4,457,994 A 7/1984 Pai et al.
4,560,635 A 12/1985 Hoffend et al.
4,599,286 A 7/1986 Limburg et al.
4,871,634 A 10/1989 Limburg et al.
5,149,609 A * 9/1992 Yu et al. ..... 430/58.7
5,368,967 A 11/1994 Schank et al.
5,418,107 A 5/1995 Nealey et al.
5,681,679 A 10/1997 Schank et al.
5,702,854 A 12/1997 Schank et al.
5,709,974 A 1/1998 Yuh et al.
5,976,744 A 11/1999 Fuller et al.
6,004,709 A 12/1999 Renfer et al.
2007/0134573 A1 * 6/2007 Yanus et al. ..... 430/66

OTHER PUBLICATIONS

Technical Data Sheet for "SOVERMOL® 750," Cognis, May 23, 2005.
Technical Data Sheet for "DESMOPHEN® 800," Bayer, May 12, 2004.

* cited by examiner

*Primary Examiner*—Hoa Van Le
(74) *Attorney, Agent, or Firm*—Oliff & Berridge, PLC

(57) ABSTRACT

An electrophotographic imaging member includes a substrate, a charge generating layer, a charge transport layer, and an overcoating layer, the overcoating layer including a cured polyester polyol or cured acrylated polyol film forming resin and a charge transport material.

25 Claims, No Drawings

PHOTORECEPTOR WITH IMPROVED OVERCOAT LAYER

BACKGROUND

This disclosure relates to electrophotographic imaging members and, more specifically, to layered photoreceptor structures with an improved overcoat layer. In particular, this disclosure relates to electrophotographic imaging members with an improved overcoat layer comprising, as a binder material, a polyester-polyol or polyether-ester polyol, and a hole transporting molecule. This disclosure also relates to processes for making and using the imaging members.

Electrophotographic imaging members, i.e. photoreceptors, typically include a photoconductive layer formed on an electrically conductive substrate. The photoconductive layer is an insulator in the dark so that electric charges are retained on its surface. Upon exposure to light, the charge is dissipated.

Many advanced imaging systems are based on the use of small diameter photoreceptor drums. The use of small diameter drums places a premium on photoreceptor life. A major factor limiting photoreceptor life in copiers and printers, is wear. The use of small diameter drum photoreceptors exacerbates the wear problem because, for example, 3 to 10 revolutions are required to image a single letter size page. Multiple revolutions of a small diameter drum photoreceptor to reproduce a single letter size page can require up to 1 million cycles from the photoreceptor drum to obtain 100,000 prints, a desirable goal for commercial systems.

For low volume copiers and printers, bias charging rolls (BCR) are desirable because little or no ozone is produced during image cycling. However, the micro corona generated by the BCR during charging, damages the photoreceptor, resulting in rapid wear of the imaging surface, e.g., the exposed surface of the charge transport layer. For example, wear rates can be as high as about 16 microns per 100,000 imaging cycles. Similar problems are encountered with bias transfer roll (BTR) systems. One approach to achieving longer photoreceptor drum life is to form a protective overcoat on the imaging surface, e.g. the charge transporting layer of a photoreceptor. This overcoat layer must satisfy many requirements, including transporting holes, resisting image deletion, resisting wear, avoidance of perturbation of underlying layers during coating.

Various overcoats employing alcohol soluble polyamides have been proposed in the prior art. One of the earliest ones is an overcoat comprising an alcohol soluble polyamide without any methyl methoxy groups (Elvamide) containing N,N'-diphenyl-N,N'-bis(3-hydroxyphenyl)-[1,1'-biphenyl]-4,4'-diamine. This overcoat is described in U.S. Pat. No. 5,368,967, the entire disclosure thereof being incorporated herein by reference. Although this overcoat had very low wear rates in machines employing corotrons for charging, the wear rates were higher in machines employing BCR. A cross linked polyamide overcoat overcame this shortcoming. This overcoat comprised a cross linked polyamide (e.g. Luckamide) containing N,N'-diphenyl-N,N'-bis(3-hydroxyphenyl)-[1,1'-biphenyl]-4,4'-diamine. In order to achieve cross linking of the polyamide polymer, Luckamide, having methyl methoxy groups was employed along with a catalyst such as oxalic acid. This tough overcoat is described in U.S. Pat. No. 5,702,854, the entire disclosure thereof being incorporated herein by reference. With this overcoat, very low wear rates were obtained in machines employing bias charging rolls (BCR) and Bias Transfer Rolls (BTR). Durable photoreceptor overcoatings containing cross linked polyamide (e.g. Luckamide) containing N,N'-diphenyl-N,N'-bis(3-hydroxyphenyl)-[1,1'-biphenyl]-4,4'-diamine (DHTBD) (Luckamide-DHTBD) have been prepared using oxalic acid and trioxane to improve photoreceptor life by at least a factor of 3 to 4. Such improvement in the bias charging roll (BCR) wear resistance involved crosslinking of Luckamide under heat treatment, e.g. 110° C.-120° C. for 30 minutes. However, adhesion of this overcoat to certain photoreceptor charge transport layers, containing certain polycarbonates (e.g., Z-type 300) and charge transport materials (e.g., bis-N,N-(3,4-dimethylphenyl)-N-(4-biphenyl) amine and N,N'-diphenyl-N,N'-bis(3-methylphenyl)-[1,1'-biphenyl]-4,4'-diamine) is greatly reduced under such drying conditions. On the other hand, under drying conditions of below about 110° C., the overcoat adhesion to the charge transport layer was good, but the overcoat had a high rate of wear. Thus, there was an unacceptably small drying conditions window for the overcoat to achieve the targets of both adhesion and wear rate.

U.S. Pat. No. 5,702,854 describes an electrophotographic imaging member including a supporting substrate coated with at least a charge generating layer, a charge transport layer and an overcoating layer, said overcoating layer comprising a dihydroxy arylamine dissolved or molecularly dispersed in a crosslinked polyamide matrix. The overcoating layer is formed by crosslinking a crosslinkable coating composition including a polyamide containing methoxy methyl groups attached to amide nitrogen atoms, a crosslinking catalyst and a dihydroxy amine, and heating the coating to crosslink the polyamide. The electrophotographic imaging member may be imaged in a process involving uniformly charging the imaging member, exposing the imaging member with activating radiation in image configuration to form an electrostatic latent image, developing the latent image with toner particles to form a toner image, and transferring the toner image to a receiving member.

U.S. Pat. No. 5,681,679 discloses a flexible electrophotographic imaging member including a supporting substrate and a resilient combination of at least one photoconductive layer and an overcoating layer, the at least one photoconductive layer comprising a hole transporting arylamine siloxane polymer and the overcoating comprising a crosslinked polyamide doped with a dihydroxy amine. This imaging member may be utilized in an imaging process including forming an electrostatic latent image on the imaging member, depositing toner particles on the imaging member in conformance with the latent image to form a toner image, and transferring the toner image to a receiving member.

U.S. Pat. No. 6,004,709 discloses an allyloxypolyamide composition, the allyloxypolyamide being represented by a specific formula. The allyloxypolyamide may be synthesized by reacting an alcohol soluble polyamide with formaldehyde and an allylalcohol. The allyloxypolyamide may be cross linked by a process selected from the group consisting of (a) heating an allyloxypolyamide in the presence of a free radical catalyst, and (b) hydrosilation of the double bond of the allyloxy group of the allyloxypolyamide with a silicon hydride reactant having at least 2 reactive sites. A preferred article comprises a substrate, at least one photoconductive layer, and an overcoat layer comprising a hole transporting hydroxy arylainine compound having at least two hydroxy functional groups, and a cross linked allyloxypolyamide film forming binder. A stabilizer may be added to the overcoat.

U.S. Pat. No. 5,976,744 discloses an electrophotographic imaging member is disclosed including a supporting substrate coated with at least one photoconductive layer, and an overcoating layer, the overcoating layer including a hydroxy functionalized aromatic diamine and a hydroxy functionalized triarylamine dissolved or molecularly dispersed in a crosslinked acrylated polyamide matrix, the hydroxy functionalized triarylamine being a compound different from the polyhydroxy functionalized aromatic diamine. The overcoating layer is formed by coating. The electrophotographic imaging member may be imaged in a process.

U.S. Pat. No. 5,709,974 discloses an electrophotographic imaging member including a charge generating layer, a charge transport layer and an overcoating layer, the transport layer including a charge transporting aromatic diamine molecule in a polystyrene matrix and the overcoating layer including a hole transporting hydroxy arylamine compound having at least two hydroxy functional groups and a polyamide film forming binder capable of forming hydrogen bonds with the hydroxy functional groups of the hydroxy arylamine compound. This imaging member is utilized in an imaging process.

U.S. Pat. No. 5,368,967 discloses an electrophotographic imaging member comprising a substrate, a charge generating layer, a charge transport layer, and an overcoat layer comprising a small molecule hole transporting arylamine having at least two hydroxy functional groups, a hydroxy or multihydroxy triphenyl methane and a polyamide film forming binder capable of forming hydrogen bonds with the hydroxy functional groups the hydroxy arylamine and hydroxy or multihydroxy triphenyl methane. This overcoat layer may be fabricated using an alcohol solvent. This electrophotographic imaging member may be utilized in an electrophotographic imaging process. Specific materials including Elvamide polyamide and N,N'-diphenyl-N,N'-bis (3-hydroxyphenyl)-[1,1'-biphenyl]-4,4'-diamine and bis-[2-methyl-4-(N-2-hydroxyethyl-N-ethyl-aminophenyl)]-phenylmethane are disclosed in this patent.

U.S. Pat. No. 4,871,634 discloses an electrostaeographic imaging member which contains at least one electrophotoconductive layer, the imaging member comprising a photogenerating material and a hydroxy arylamine compound represented by a certain formula. The hydroxy arylamine compound can be used in an overcoating with the hydroxy arylamine compound bonded to a resin capable of hydrogen bonding such as a polyamide possessing alcohol solubility.

U.S. Pat. No. 4,297,425 discloses a layered photosensitive member comprising a generator layer and a transport layer containing a combination of diamine and triphenyl methane molecules dispersed in a polymeric binder.

U.S. Pat. No. 4,050,935 discloses a layered photosensitive member comprising a generator layer of trigonal selenium and a transport layer of bis(4-diethylamino-2-methylphenyl) phenylmethane molecularly dispersed in a polymeric binder.

U.S. Pat. No. 4,457,994 discloses a layered photosensitive member is disclosed comprising a generator layer and a transport layer containing a diamine type molecule dispersed in a polymeric binder and an overcoat containing triphenyl methane molecules dispersed in a polymeric binder.

U.S. Pat. No. 4,281,054 discloses an imaging member comprising a substrate, an injecting contact, or hole injecting electrode overlying the substrate, a charge transport layer comprising an electrically inactive resin containing a dispersed electrically active material, a layer of charge generator material and a layer of insulating organic resin overlying the charge generating material. The charge transport layer can contain triphenylmethane.

U.S. Pat. No. 4,599,286 discloses an electrophotographic imaging member comprising a charge generation layer and a charge transport layer, the transport layer comprising an aromatic amine charge transport molecule in a continuous polymeric binder phase and a chemical stabilizer selected from the group consisting of certain nitrone, isobenzofuran, hydroxyaromatic compounds and mixtures thereof. An electrophotographic imaging process using this member is also described.

U.S. Pat. No. 5,418,107 discloses a process for fabricating an electrophotographic imaging member including providing a substrate to be coated, forming a coating comprising photoconductive pigment particles having an average particle size of less than about 0.6 micrometer dispersed in a solution of a solvent comprising n-alkyl acetate having from 3 to 5 carbon atoms in the alkyl group and a film forming polymer consisting essentially of a film forming polymer having a polyvinyl butyral content between about 50 and about 75 mol percent, a polyvinyl alcohol, content between about 12 and about 50 mol percent, and a polyvinyl acetate content is between about 0 to 15 mol percent, the photoconductive pigment particles including a mixture of at least two different phthalocyanine pigment particles free of vanadyl phthalocyanine pigment particles, drying the coating to remove substantially all of the alkyl acetate solvent to form a dried charge generation layer comprising between about 50 percent and about 90 percent by weight of the pigment particles based on the total weight of the dried charge generation layer, and forming a charge transport layer.

Despite these various approaches, there remains a need for improved overcoat layer design, to provide increased wear resistance and resistance to moisture, such as humidity, and the like. A need also exists for improved overcoat layer design, to provide hard yet flexible layers that are more resistant to cracking. For example, the art has previously provided a range of hard overcoating layer materials. However, such overcoat layers are typically prone to cracking, especially during use, as well as humidity. Both effects tend to reduce the useful life of the photoreceptor, or limit the range of environments and printing apparatus in which the photoreceptor can be used.

SUMMARY

This disclosure addresses some or all of the above problems, and others, by providing novel, improved photoreceptor overcoat layers. The overcoat layers generally include, as a binder material, a polyester-polyol or acrylated polyol, and a hole transporting molecule. The polyester-polyol or acrylated polyol, can be mixed with suitable crosslinking materials such as crosslinking agents and/or catalysts, to form the overcoating layer.

More particularly, in embodiments, the present disclosure provides an electrophotographic imaging member comprising:

a substrate, a charge generating layer, a charge transport layer, and an overcoating layer, said overcoating layer comprising a cured polyester polyol or cured acrylated polyol film forming resin and a charge transport material.

The present disclosure also provides electrographic image development devices comprising such electrophotographic imaging members. Also provided are imaging processes using such electrophotographic imaging members.

Further, the present disclosure also provides a process for forming an electrophotographic imaging member comprising:

providing an electrophotographic imaging member comprising a substrate, a charge generating layer, and a charge transport layer, and forming thereover an overcoating layer comprising a cured polyester polyol or cured acrylated polyol film forming resin and a charge transport material.

In embodiments, the forming step can comprise providing a solution comprising said polyester polyol or acrylated polyol and said charge transport material, in a solvent; coating said solution on said electrophotographic imaging member; and crosslinking said polyester polyol or acrylated polyol to form a cured polymeric film.

DETAILED DESCRIPTION OF PREFERRED EMBODIMENTS

Electrophotographic imaging members are well known in the art. Electrophotographic imaging members may be prepared by any suitable technique. Typically, a flexible or rigid substrate is provided with an electrically conductive surface. A charge generating layer is then applied to the electrically conductive surface. A charge blocking layer may optionally be applied to the electrically conductive surface prior to the application of a charge generating layer. If desired, an adhesive layer may be utilized between the charge blocking layer and the charge generating layer. Usually the charge generation layer is applied onto the blocking layer and a charge transport layer is formed on the charge generation layer. This structure may have the charge generation layer on top of or below the charge transport layer.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be between about 20 angstroms to about 750 angstroms, and more preferably from about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer may be applied to the substrate. Any suitable and conventional blocking layer capable of forming an electronic barrier to holes between the adjacent photoconductive layer and the underlying conductive surface of a substrate may be utilized.

An optional adhesive layer may be applied to the hole blocking layer. Any suitable adhesive layer well known in the art may be utilized. Typical adhesive layer materials include, for example, polyesters, polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

At least one electrophotographic imaging layer is formed on the adhesive layer, blocking layer or substrate. The electrophotographic imaging layer may be a single layer that performs both charge generating and charge transport functions as is well known in the art or it may comprise multiple layers such as a charge generator layer and charge transport layer. Charge generator layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge generator layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakisazos; and the like dispersed in a film forming polymeric binder and fabricated by solvent coating techniques.

Phthalocyanines have been employed as photogenerating materials for use in laser printers utilizing infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms which have a strong influence on photogeneration.

Any suitable polymeric film forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition. The photogenerator layers can also fabricated by vacuum sublimation in which case there is no binder.

Any suitable and conventional technique may be utilized to mix and thereafter apply the photogenerating layer coating mixture. Typical application techniques include spraying, dip coating, roll coating, wire wound rod coating, vacuum sublimation and the like. For some applications, the generator layer may be fabricated in a dot or line pattern. Removing of the solvent of a solvent coated layer may be effected by any suitable conventional technique such as oven drying, infrared radiation drying, air drying and the like.

The charge transport layer may comprise a charge transporting small molecule dissolved or molecularly dispersed in a film forming electrically inert polymer such as a polycarbonate. The term "dissolved" as employed herein is defined herein as forming a solution in which the small molecule is dissolved in the polymer to form a homogeneous phase. The expression "molecularly dispersed" is used herein is defined as a charge transporting small molecule dispersed in the polymer, the small molecules being dispersed in the polymer on a molecular scale. Any suitable charge transporting or electrically active small molecule may be employed in the charge transport layer. The expression charge transporting "small molecule" is defined herein as a monomer that allows the free charge photogenerated in the transport layer to be transported across the transport layer. Typical charge transporting small molecules include, for example, pyrazolines such as 1-phenyl-3-(4'-diethylamino styryl)-5-(4"-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis (4-N,N'-diethylaminophenyl)-1,2,4-oxadiazole, stilbenes and the like. As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-diamine. If desired, the charge transport material in the charge transport layer may comprise a polymeric charge transport material or a combination of a small molecule charge transport material and a polymeric charge transport material.

Any suitable electrically inactive resin binder insoluble in the alcohol solvent used to apply the overcoat layer may be employed in the charge transport layer. Typical inactive resin binders include polycarbonate resin, polyester, polyarylate, polysulfone, and the like. Molecular weights can vary, for example, from about 20,000 to about 150,000. Preferred binders include polycarbonates such as poly(4,4'-isopropylidene-diphenylene)carbonate (also referred to as bisphenol-A-polycarbonate, poly(4,4'-cyclohexylidine-diphenylene) carbonate (referred to as bisphenol-Z polycarbonate), poly(4,4'-isopropylidene-3,3'-dimethyl-diphenyl) carbonate (also referred to as bisphenol-C-polycarbonate) and the like. Any suitable charge transporting polymer may also be utilized in the charge transporting layer. The charge transporting polymer should be insoluble in any solvent employed to apply the subsequent overcoat layer described below, such as an alcohol solvent. These electrically active charge transporting polymeric materials should be capable of supporting the injection of photogenerated holes from the charge generation material and be incapable of allowing the transport of these holes therethrough.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers is preferably maintained from about 2:1 to 200:1 and in some instances as great as 400:1. The charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

To improve photoreceptor wear resistance, a protective overcoat layer is provided over the charge transport layer. The overcoat layer generally includes at least a film-forming resin and a hole transporting molecule. The overcoating layer can be formed, for example, from a solution or other suitable mixture of the film-forming resin and hole transporting molecule, and other optional additives.

The film-forming resin used in forming the overcoating layer is specifically a polyester polyol or acrylated polyol, preferably a highly branched polyester polyol or acrylated polyol. By "highly branched" is meant a prepolymer synthesized using a significant amount of trifunctional alcohols, such as triols, to form a polymer having a significant number of branches off of the main polymer chain. This is distinguished from a linear prepolymer that contains only difunctional monomers, and thus little or no branches off of the main polymer chain. As used herein, "polyester polyol" is meant to encompass such compounds that include multiple ester groups as well as multiple alcohol (hydroxyl) groups in the molecule, and which can include other groups such as, for example, ether groups and the like. In embodiments, the polyester polyol can thus include ether groups, or can be free of ether groups. Likewise, as used herein, "acrylated polyol" is meant to encompass such compounds that include multiple ether groups as well as multiple alcohol (hydroxyl) groups in the molecule, and which can include acrylate groups such as, for example, methacrylate groups and the like.

It has been found that such polyester polyols and acrylated polyols provide improved results when incorporated as a binder in the overcoating layer. Specifically, the polyester polyols and acrylated polyols provide hard binder layers, but which layers remain flexible and are not prone to crack formation.

Examples of such suitable polyester polyols include, for example, polyester polyols formed from the reaction of a polycarboxylic acid such as a dicarboxylic acid or a tricarboxylic acid (including acid anhydrides) with a polyol such as a diol or a triol. Preferably, the number of ester and alcohol groups, and the relative amount and type of polyacid and polyol, should be selected such that the resulting polyester polyol compound retains a number of free hydroxyl groups, which can be used for subsequent crosslinking of the material in forming the overcoating layer binder material. For example, suitable polycarboxylic acids include, but are not limited to, adipic acid ($COOH[CH_2]_4COOH$), pimelic acid ($COOH[CH_2]_5COOH$), suberic acid ($COOH[CH_2]_6COOH$), azelaic acid ($COOH[CH_2]_7COOH$), sebasic acid ($COOH[CH_2]_8COOH$), and the like. Suitable polyols include, but are not limited to, difunctional materials such as glycols or trifunctional alcohols such as triols and the like, including propanediols ($HO[CH_2]_3OH$), butanediols ($HO[CH_2]_4OH$), hexanediols ($HO[CH_2]_6OH$), glycerine ($HOCH_2CHOHCH_2OH$), 1,2,6-Hexane triol ($HOCH_2CHOH[CH_2]_4OH$), and the like.

In embodiments, the suitable polyester polyols are reaction products of polycarboxylic acids and polyols and can be represented by the following formula (1):

$$—[—C—R_a—C]_m—[—CO_2—R_b—CO_2—]_n——[—C—R_c—C]_p—[—CO_2—R_d—CO_2—]_q \quad (1)$$

where Ra and Rc independently represent linear alkyl groups or branched alkyl groups derived from the polyols, the alkyl groups having from 1 to about 20 carbon atoms; Rb and Rd independently represent alkyl groups derived from the polycarboxylic acids, the alkyl groups having from 1 to about 20 carbon atoms; and m, n, p, and q represent mole fractions of from 0 to 1, such that n+m+p+q=1.

Specific commercially available examples of such suitable polyester polyols include, for example: the DESMOPHEN® series of products available from Bayer Chemical, including the DESMOPHEN® 800, 1110, 1112, 1145, 1150, 1240, 1262, 1381, 1400, 1470, 1630, 2060, 2061, 2062, 3060, 4027, 4028, 404, 4059, 5027, 5028, 5029, 5031, 5035, and 5036 products; the SOVERMOL® series of products available from Cognis, including the SOVERMOL®750, 805, 815, 908, 910, and 913 products; and the HYDAGEN® series of products available from Cognis, including the HYDAGEN® HSP product; and mixtures thereof. Particularly preferred in embodiments are DESMOPHEN® 800 and SOVERMOL® 750, or mixtures thereof. DESMOPHEN® 800 is a highly branched polyester bearing hydroxyl groups, having an acid value of ≦4 mg KOH/g, a hydroxyl content of about 8.6±0.3%, and an equivalent weight of about 200. DESMOPHEN® 800 corresponds to the above formula (1) where the polymer contains 50 parts adipic acid, 10 parts phthalic anhydride, and 40 parts 1,2,6-hexanetriol, where Rb═—$[CH_2]_4$—, n=0.5, Rd=—1,2—$C_6H_4$—, q=0.1, Ra=Rc=—$CH_2[CHO—][CH_2]_4$—, and m+p=0.4. DESMOPHEN® 1100 corresponds to the above formula (1) where the polymer contains 60 parts adipic acid, 40 parts 1,2,6-hexanetriol, and 60 parts 1,4-butanediol, where Rb=Rd=—$[CH_2]_4$—, n+q=0.375, Ra═—$CH_2[CHO—][CH_2]_4$—, m=0.25, Rc=—$[CH_2]_4$—, and p=0.375. SOVERMOL® 750 is a branched polyether/polyester/polyol having an acid value of ≦2 mg KOH/g, and a hydroxyl value of 300-330 mg KOH/g.

In other embodiments, the film-forming resin can be an acrylated polyol. Suitable acrylated polyols can be, for example, the reaction products of propylene oxide modified with ethylene oxide, glycols, triglycerol and the like. These polyols are further reacted with substituted acrylic acids, alcohol containing acrylates, substituted acryloyl chlorides, and the like, forming terminal acrylate groups. Such acrylated polyols can be represented by the following formula (2):

$$[R_t—CH2-]_t—\{[—C—R_a—C]_m—[—CO—R_b—CO—]_n——[—C—R_c—C]_p—[—CO—R_d—CO—]_q\} \quad (2)$$

where $R_t$ represent $CH_2CR_1CO2$- where $R_1$ is an alkyl group of from 1 to about 20 carbon atoms or more such as methyl, ethyl, and the like and where t represents mole fractions of acrylated sites from 0 to 1. Ra and Rc, independently represent linear alkyl/alkoxy groups or branched alkyl/alkoxy groups derived from the polyols, the alkyl/alkoxy groups having from 1 to about 20 carbon atoms; Rb and Rd independently represent alkyl/alkoxy groups, the alkyl/alkoxy groups having from 1 to about 20 carbon atoms; and m, n, p, and q represent mole fractions of from 0 to 1, such that n+m+p+q=1. In formula (2), the notation "$[R_t—CH2—]_t$-" indicates that the acrylate groups react with some of the hydroxyl groups in the main chain or branches of the polyol component.

In forming the binder material for the overcoating layer, any suitable crosslinking agents, catalysts, and the like can be included in known amounts for known purposes. For example, it is particularly preferred in embodiments that a crosslinking agent or accelerator, such as a melamine crosslinking agent or accelerator, be included with the polyester polyol or acrylated polyol for forming the overcoating layer. Incorporation of a crosslinking agent or accelerator provides reaction sites to interact with the polyester polyol or acrylated polyol, to provide a branched, crosslinked structure. When so incorporated, any suitable crosslinking agent or accelerator can be used, including, for example, trioxane, melamine compounds, and mixtures thereof. Where melamine compounds are used, they can be suitable functionalized to be, for example, melamine formaldehyde, methoxymethylated melamine compounds, such as glycourilformaldehyde and benzoguanamine-formaldehyde, and the like. An example of a suitable methoxymethylated melamine compound is Cymel 303 (available from Cytec Industries), which is a methoxymethylated melamine compound with the formula $(CH_3OCH_2)_6N_3C_3N_3$ and the following structure:

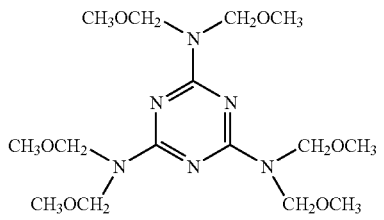

Crosslinking is generally accomplished by heating in the presence of a catalyst. Thus, the solution of the polyester polyol or acrylated polyol can also preferably include a suitable catalyst. Any suitable catalyst may be employed. Typical catalysts include, for example, oxalic acid, maleic acid, carbollylic acid, ascorbic acid, malonic acid, succinic acid, tartaric acid, citric acid, p-toluenesulfonic acid, methanesulfonic acid, and the like and mixtures thereof.

If desired or necessary, a blocking agent can also be included. A blocking agent can be used to "tie up" or block the acid effect to provide solution stability until the acid catalyst function is desired. Thus, for example, the blocking agent can block the acid effect until the solution temperature is raised above a threshold temperature. For example, some blocking agents can be used to block the acid effect until the solution temperature is raised above about 100° C. At that time, the blocking agent dissociates from the acid and vaporizes. The unassociated acid is then free to catalyze the polymerization. Examples of such suitable blocking agents include, but are not limited to, pyridine and commercial acid solutions containing blocking agents such as Cycat 4040 available from Cytec Ind.

The temperature used for crosslinking varies with the specific catalyst and heating time utilized and the degree of crosslinking desired. Generally, the degree of crosslinking selected depends upon the desired flexibility of the final photoreceptor. For example, complete crosslinking may be used for rigid drum or plate photoreceptors. However, partial crosslinking is preferred for flexible photoreceptors having, for example, web or belt configurations. The degree of crosslinking can be controlled by the relative amount of catalyst employed. The amount of catalyst to achieve a desired degree of crosslinking will vary depending upon the specific coating solution materials, such as polyol, catalyst, temperature and time used for the reaction. Preferably, the polyol is cross linked at a temperature between about 100° C. and about 150° C. A typical cross linking temperature used for polyols with p-toluenesulfonic acid as a catalyst is less than about 140° C. for about 40 minutes. A typical concentration of acid catalyst is between about 0.01 and about 5.0 weight percent based on the weight of polyol. After crosslinking, the overcoating should be substantially insoluble in the solvent in which it was soluble prior to crosslinking. Thus, no overcoating material will be removed when rubbed with a cloth soaked in the solvent. Crosslinking results in the development of a three dimensional network which restrains the transport molecule in the crosslinked polymer network.

Any suitable alcohol solvent may be employed for the film forming polymers. Typical alcohol solvents include, for example, butanol, propanol, methanol, 1-methoxy-2-propanol, and the like and mixtures thereof. Other suitable solvents that can be used in forming the overcoating layer solution include, for example, tetrahydrofuran, monochlorobenzene, and mixtures thereof. These solvents can be used in addition to, or in place of, the above alcohol solvents, or they can be omitted entirely. However, in some embodiments, it is preferred that higher boiling alcohol solvents be avoided, as they can interfere with the desired cross-linking reaction.

Any suitable hole transport material may be utilized in the overcoating layer. Preferably, the hole transport material is an alcohol soluble polyhydroxy diaryl amine small molecule charge transport material having at least two hydroxy functional groups. An especially preferred small molecule hole transporting material can be represented by the following formula:

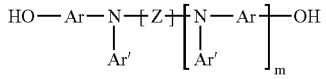

wherein:

m is 0 or 1,

Z is selected from the group consisting of:

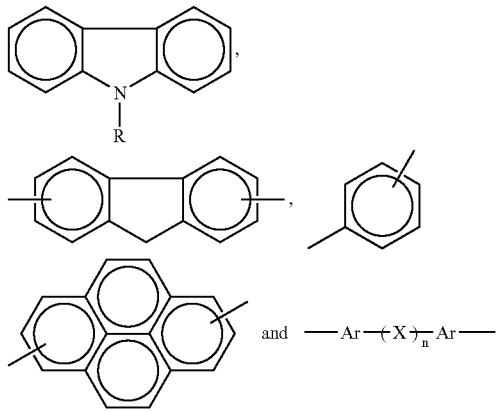

n is 1 or 1,

Ar is selected from the group consisting of:

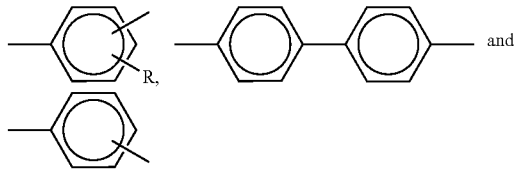

R is selected from the group consisting of —$CH_3$, —$C_2H_5$, —$C_3H_7$, and —$C_4H_9$, Ar' is selected from the group consisting of:

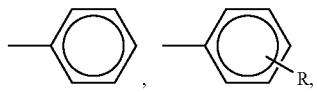

-continued

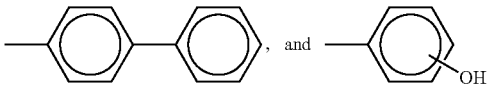

X is selected from the group consisting of:

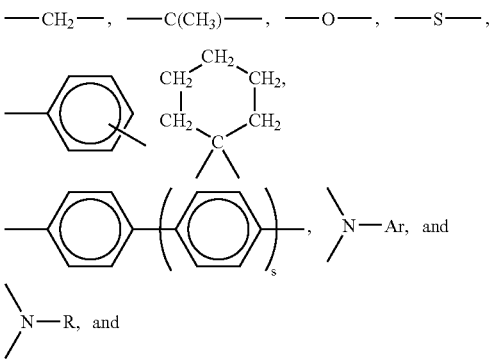

s is 0,1 or 2, the dihydroxy arylamine compound preferably being free of any direct conjugation between the ——OH groups and the nearest nitrogen atom through one or more aromatic rings.

The expression "direct conjugation" is defined as the presence of a segment, having the formula —$(C{=}C)_n$—C═C— in one or more aromatic rings directly between an —OH group and the nearest nitrogen atom. Examples of direct conjugation between the —OH groups and the nearest nitrogen atom through one or more aromatic rings include a compound containing a phenylene group having an —OH group in the ortho or para position (or 2 or 4 position) on the phenylene group relative to a nitrogen atom attached to the phenylene group or a compound containing a polyphenylene group having an —OH group in the ortho or para position on the terminal phenylene group relative to a nitrogen atom attached to an associated phenylene group.

Typical polyhydroxy arylamine compounds utilized in the overcoat of embodiments include, for example: N,N'-diphenyl-N,N'-bis(3-hydroxyphenyl)-[1,1'-biphenyl]-4,4'-diamine; N,N,N',N',-tetra(3-hydroxyphenyl)-[1,1'-biphenyl]-4,4'-diamine; N,N-di(3-hydroxyphenyl)-m-toluidine; 1,1-bis-[4-(di-N,N-m-hydroxyphenyl)-aminophenyl]-cyclohexane; 1,1-bis[4-(N-m-hydroxyphenyl)-4-(N-phenyl)-aminophenyl]-cyclohexane; bis-(N-(3-hydroxyphenyl)-N-phenyl-4-aminophenyl)-methane; bis[(N-(3-hydroxyphenyl)-N-phenyl)-4-aminophenyl]-isopropylidene; N,N'-diphenyl-N,N'-bis(3-hydroxyphenyl)-[1,1'4',1"-terphenyl]-4,4"-diamine; 9-ethyl-3.6-bis[N-phenyl-N-3(3-hydroxyphenyl)-amino]-carbazole; 2,7-bis[N,N-di(3-hydroxyphenyl)-amino]-fluorene; 1,6-bis[N,N-di(3-hydroxyphenyl)-amino]-pyrene; 1,4-bis[N-phenyl-N-(3-hydroxyphenyl)]-phenylenediamine.

The thickness of the continuous overcoat layer selected depends upon the abrasiveness of the charging (e.g., bias charging roll), cleaning (e.g., blade or web), development (e.g., brush), transfer (e.g., bias transfer roll), etc., in the system employed and can range from about 1 or about 2 microns up to about 10 or about 15 microns or more. A thickness of between about 1 micrometer and about 5 micrometers in thickness is preferred, in embodiments. Typical application techniques include spraying, dip coating, roll coating, wire wound rod coating, and the like. Drying of the deposited coating may be effected by any suitable conventional technique such as oven drying, infrared radiation drying, air drying and the like. The dried overcoating of this disclosure should transport holes during imaging and should not have too high a free carrier concentration. Free carrier concentration in the overcoat increases the dark decay. Preferably the dark decay of the overcoated layer should be about the same as that of the unovercoated device.

In the dried overcoating layer, the composition can include from about 10 to about 90 percent by weight film-forming binder, and from about 90 to about 10 percent by weight hole transporting molecule. For example, in embodiments, the hole transporting molecule can be incorporated into the overcoating layer in an amount of from about 20 to about 70 percent by weight, such as about 33 percent by weight. As desired, the overcoating layer can also include other materials, such as conductive fillers, abrasion resistant fillers, and the like, in any suitable and known amounts.

Advantages provided by the present disclosure include, in embodiments, overcoating layers that are hard yet flexible. Some traditional overcoat layers are hard but inflexible, resulting in crack formation during flexing and use. This problem is exacerbated by exposure of the overcoating layer to corona discharge, a necessary part of electrostatographic printing. Corona discharge can increase the crack rate of the overcoating layers, resulting in shortened lifetime and poor image formation. However, in embodiments, the present disclosure provides hard yet flexible overcoating layers. The overcoating layers are hard, which means that they can withstand wear to a great extent, but they are also flexible, meaning that they can resist cracking during flexing and under corona exposure. A further benefit of the overcoating layers is that they can be electrically transparent, meaning that additional changes to the photoreceptor are not required in order to incorporate the disclosed overcoating layers.

A further advantage, in embodiments, is that the overcoating layer, and thus the entire imaging member structure, are less sensitive to atmospheric moisture. Lower moisture sensitivity allows the imaging member to perform more predictably, and more uniformly, in different temperature/humidity environments.

Also, included within the scope of the present disclosure are methods of imaging and printing with the imaging members illustrated herein. These methods generally involve the formation of an electrostatic latent image on the imaging member; followed by developing the image with a toner composition comprised, for example, of thermoplastic resin, colorant, such as pigment, charge additive, and surface additives, reference U.S. Pat. Nos. 4,560,635, 4,298,697 and 4,338,390, the disclosures of which are totally incorporated herein by reference; subsequently transferring the image to a suitable substrate; and permanently affixing the image thereto. In those environments wherein the device is to be used in a printing mode, the imaging method involves the same steps with the exception that the exposure step can be accomplished with a laser device or image bar.

An example is set forth hereinbelow and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

EXAMPLES

Example 1

Preparation of Overcoating Composition

A coating composition is formed containing 4 grams DESMOPHEN® 800 polyester polyol, 2.4 grams Cymel 1130, 18 grams 1-methoxy-2-propanol (Dowanol), and 3.2 grams N,N'-diphenyl-N,N'-bis(3-hydroxyphenyl)-[ 1,1'-biphenyl]-4,4'-diamine in a 1 ounce bottle. The components are mixed and the temperature is raised to about 40° C. until a complete solution is achieved. Next, 0.9 grams of p-toluenesulfonic acid/pyridine (8% acid/2% pyridine in 1-methoxy-2-propanol) (0.072 grams acid, 0.75% by weight) as catalyst is added Example 2

Preparation of Overcoated Imaging Member

An overcoated imaging member sheet or belt is formed using the coating composition of Example 1. In particular, an electrophotographic imaging member web stock is prepared by providing a 0.02 micrometer thick titanium layer coated on a biaxially oriented polyethylene naphthalate substrate (Kadalex, available from ICI Americas, Inc.) having a thickness of 3.5 mils (89 micrometers) and applying thereto, using a gravure coating technique and a solution containing 10 grams gamma aminopropyltriethoxy silane, 10.1 grams distilled water, 3 grams acetic acid, 684.8 grams of 200 proof denatured alcohol and 200 grams heptane. This layer is then allowed to dry for 5 minutes at 135° C. in a forced air oven. The resulting blocking layer has an average dry thickness of 0.05 micrometer measured with an ellipsometer.

An adhesive interface layer is then prepared by applying with extrusion process to the blocking layer a wet coating containing 5 percent by weight based on the total weight of the solution of polyester adhesive (Mor-Ester 49,000, available from Morton International, Inc.) in a 70:30 volume ratio mixture of tetrahydrofuran:cyclohexanone. The adhesive interface layer is allowed to dry for 5 minutes at 135° C. in a forced air oven. The resulting adhesive interface layer has a dry thickness of 0.065 micrometer The adhesive interface layer is thereafter coated with a photogenerating layer. The photogenerating layer dispersion is prepared by introducing 0.45 grams of Iupilon 200 (PC-Z 200) available from Mitsubishi Gas Chemical Corp and 50 ml of tetrahydrofuran into a 4 oz. glass bottle. To this solution is added 2.4 grams of hydroxygallium phthalocyanine and 300 grams of ⅛ inch (3.2 millimeter) diameter stainless steel shot. This mixture is then placed on a ball mill for 20 to 24 hours. Subsequently, 2.25 grams of PC-Z 200 is dissolved in 46.1 gm of tetrahydrofuran, then added to this OHGaPc slurry. This slurry is then placed on a shaker for 10 minutes. The resulting slurry is, thereafter, coated onto the adhesive interface by an extrusion application process to form a layer having a wet thickness of 0.25 mil. However, a strip about 10 mm wide along one edge of the substrate web bearing the blocking layer and the adhesive layer is deliberately left uncoated by any of the photogenerating layer material to facilitate adequate electrical contact by the ground strip layer that is applied later. This photogenerating layer is dried at 135° C. for 5 minutes in a forced air oven to form a dry thickness photogenerating layer having a thickness of 0.4 micrometer layer.

This coated imaging member web is simultaneously overcoated with a charge transport layer and a ground strip layer using extrusion co-coating process. The charge transport layer is prepared by introducing into an amber glass bottle a weight ratio of 1:1 N,N'-diphenyl-N,N'-bis(3-methylphenyl)-1,1'-biphenyl-4-4'-diamine, and Makrolon 5705, a polycarbonate resin having a weight average molecular weight of about 120,000 commercially available from Bayer A. G. The resulting mixture is dissolved to give a 15 percent by weight solid in 85 percent by weight methylene chloride. This solution is applied onto the photogenerator layer to form a coating which upon drying has a thickness of 29 micrometers.

The approximately 10 mm wide strip of the adhesive layer left uncoated by the photogenerator layer is coated over with a ground strip layer during the co-coating process. This ground strip layer, after drying along with the co-coated charge transport layer at 135° C. in the forced air oven for minutes, has a dried thickness of about 19 micrometers. This ground strip is electrically grounded, by conventional means such as a carbon brush contact means during conventional xerographic imaging process.

An anticurl coating is prepared by combining 8.82 grams of polycarbonate resin (Makrolon 5705, available from Bayer AG), 0.72 gram of polyester resin (Vitel PE-200, available from Goodyear Tire and Rubber Company) and 90.1 grams of methylene chloride in a glass container to form a coating solution containing 8.9 percent solids. The container is covered tightly and placed on a roll mill for about 24 hours until the polycarbonate and polyester are dissolved in the methylene chloride to form the anticurl coating solution. The anticurl coating solution is then applied to the rear surface (side opposite the photogenerator layer and charge transport layer) of the imaging member web stock, again by extrusion coating process, and dried at 135° C. for about 5 minutes in the forced air oven to produce a dried film thickness of about 17 micrometers.

The sheet is overcoated with the overcoat layer composition of Example 1. The coating composition is applied using a 0.125 mil Bird bar applicator and dried at 125° C. for 4 minutes. The result is an imaging member having an overcoating layer thickness of 3 microns.

Comparative Example 2

Preparation of Overcoated Imaging Member

An imaging member is made in the same manner as in Example 2, except that the overcoating layer is omitted.

Example 3

Testing of Imaging Members

The imaging members of Example 2 and Comparative Example 2 are tested for their electrostatographic sensitivity and cycling stability in a scanner. In the scanner, each photoreceptor sheet to be evaluated is mounted on a cylindrical aluminum drum substrate that is rotated on a shaft. The devices are charged by a corotron mounted along the periphery of the drum. The surface potential is measured as a function of time by capacitively coupled voltage probes placed at different locations around the shaft. The probes are calibrated by applying known potentials to the drum substrate. Each photoreceptor sheet on the drum is exposed to a light source located at a position near the drum downstream from the corotron. As the drum is rotated, the initial (pre-exposure) charging potential is measured by voltage probe 1. Further rotation leads to an exposure station, where the photoreceptor device is exposed to monochromatic radiation of a known intensity. The devices are erased by a light source located at a position upstream of charging. The measurements illustrated in the Table below include the charging of each photoconductor device in a constant current or voltage mode. The devices are charged to a negative polarity corona. The surface potential after exposure is measured by a second voltage probe. The devices are finally exposed to an erase lamp of appropriate intensity and any residual potential is measured by a third voltage probe. The process is repeated with the magnitude of the exposure automatically changed during the next cycle. The photodischarge characteristics are obtained by plotting the potentials at voltage probe 2 as a function of light exposure. The following results show that there is no significant difference between the imaging member having no overcoat (Comparative Example 2) and the imaging member having an overcoat (Example 2).

| # cycles | Example | V(1.5) | V(2.5) | V(6) | V(3.5) |
|---|---|---|---|---|---|
| 0 | 2 | 72 | 34 | 19 | 28 |
| | Comp. 2 | 79 | 46 | 29 | 41 |
| 10,000 | 2 | 111 | 66 | 38 | 57 |
| | Comp. 2 | 141 | 100 | 68 | 89 |

Next, the imaging members of Example 2 and Comparative Example 2 are tested for corona sensitivity. Hand-coated samples of the formulations described in Example 2 and Comparative example 2 are cut into small sheets (1.5 inches×11 inches) and wrapped around a 84 mm photoreceptor drum. This drum with the sample belt wrapping around it is then exposed to corona effluents generated from a charging device. After being exposed for 30 minutes, using a DC 12 Limoges printer, the drum is printed with a target containing various types of bit lines for LCM deletion. The target print has 5 different bit lines ranging from 1 bit to 5 bit. The sample with the least number of visible lines is badly affected by corona effluents and completely deleted if there are no visible lines. The results show that after being exposed to corona effluent for 30 minutes, the imaging member having no overcoat (Comparative Example 2) has no visible printed bit lines, whereas the imaging member having an overcoat (Example 2) shows all of its bit lines during printing.

Next, the imaging members of Example 2 and Comparative Example 2 are tested for scratch resistance, by abrading the imaging members with toner carrier beads. Hand-coated samples of Example 2 and Comparative Example 2 are cut into small sheets as above and are flexed in a tri-roller flexing system. Each belt is under a 1.1 lb/inch tension and each roller is 0.5 inches in diameter. A polyurethane spots blade is placed in contact with each belt at a angle between 5 to 15 degrees. Carrier beads of about 100 micrometers in size are attached to the spots blade by the aid of a double tape. Belts are flexed for 7000 cycles. The surface morphology of each imaging member is then analyzed. The following results show that the imaging member having-no overcoat (Comparative Example 2) has deeper scratches and is less resistant to abrading by the carrier beads, whereas the imaging member having an overcoat (Example 2) shows more shallow scratches and higher resistance to abrasion by the carrier beads. In the Table, Rq is the root mean square roughness, Rz is 10 point mean roughness, and Rmax is maximum peak to valley height, all expressed in microns.

| Example | Rq | Rz | Ra | Rmax |
|---|---|---|---|---|
| 2 | 0.12 | 2.11 | 0.07 | 3.14 |
| Comp. 2 | 0.37 | 4.70 | 0.22 | 8.65 |

Lastly, the imaging members of Example 2 and Comparative Example 2 are tested for mechanical crack resistance, by flexing the belts on a tri-roller fixture with ¼ diameter rolls for 5,000 cycles before being exposed to corona effluent. The flexed and exposed areas are then printed for crack assessment. The results show that the imaging member having no overcoat (Comparative Example 2) has significantly more cracks than the imaging member having an overcoat (Example 2), and that the imaging member of Example 2 appears to be more resistant to mechanical flexing and corona effluent.

Example 4

Preparation of Polyester Polyol Overcoat

A coating composition is formed containing 7.0 grams SOVERMOL® 750 polyester polyol, 54 grams 1-methoxy-2-propanol (Dowanol PM), 5.0 grams Cymel 303 melamine formaldehyde crosslinking agent and 6.0 grams N,N'-diphenyl-N,N'-bis(3-hydroxyphenyl)-[1,1'-biphenyl]-4,4'-diamine in a 1 ounce bottle. The components are mixed and the temperature is raised to about 40° C. until a complete solution is achieved. Next, 1.68 grams of p-toluenesulfonic acid/pyridine (8% acid/2% pyridine in 1-methoxy-2-propanol) (0.135 grams acid, 0.75% by weight) as a catalyst is added.

Example 5

Preparation of Acrylated Polyol Overcoat

A coating composition is formed containing 2.5 grams Joncryl 587 [acrylated polyol from Johnson Polymers Inc]., 3.5 grams Cymel 303, 27 grams 1-methoxy-2-propanol (Dowanol PM), and 3.0 grams N,N'-diphenyl-N,N'-bis(3-hydroxyphenyl)-[1,1'-biphenyl]-4,4'-diamine in a 1 ounce bottle. The components are mixed and the temperature is raised to about 40° C. until a complete solution is achieved. Next, 0.9 grams of p-toluenesulfonic acid/pyridine (8% acid/2% pyridine in 1-methoxy-2-propanol) (0.072 grams acid, 0.75% by weight) as catalyst is added.

Example 6

Preparation of Overcoated Imaging Member

Electrophotographic imaging member are prepared by applying by dip coating a charge blocking-layer onto the rough surface of an aluminum drum having a diameter of 3 cm and a length of 31 cm. The blocking layer coating mixture is a solution of 8 weight percent polyamide (nylon 6) dissolved in a 92 weight percent butanol, methanol and water solvent mixture. The butanol, methanol and water mixture percentages are 55, 36 and 9 percent by weight, respectively. The coating is applied at a coating bath withdrawal rate of 300 millimeters/minute. After drying in a forced air oven, the blocking layer has a thickness of 1.5 micrometers. The dried blocking layer is coated with a charge generating layer containing 2.5 weight percent hydroxy gallium phthalocyanine pigment particles, 2.5 weight percent polyvinylbutyral film forming polymer and 95 weight percent cyclohexanone solvent. The coating is applied at a coating bath withdrawal rate of 300 millimeters/minute. After drying in a forced air oven, the charge generating layer has a thickness of 0.2 micrometer. The drum is subsequently coated with a charge transport layer containing N,N'-diphenyl-N,N'-bis(3-methylphenyl)-1,1;-biphenyl-4,4'-diamine dispersed in polycarbonate binder (PCZ 300, available from the Mitsubishi Chemical Company). The charge transport coating mixture consists of 8 weight percent N,N'-diphenyl-N,N'-bis(3-methylphenyl)-1,1'-biphenyl-4,4;-diamine, 12 weight percent binder and 80 weight percent monochlorobenzene solvent. The coating is applied in a Tsukiage dip coating apparatus. After drying in a forced air oven for 45 minutes at 118° C., the transport layer has a thickness of 20 micrometers.

Example 7

Preparation of Overcoated Drum Imaging Member

A drum from Example 6 is overcoated with the overcoat solution composition from Example 4. The coating composition is applied using a Tsukiage dip coating apparatus and dried at 125° C. for 40 minutes. The result is an imaging member having an overcoating layer thickness of from about 2.5 to about 3.0 microns.

Example 8

Preparation of Overcoated Drum Imaging Member

A drum from Example 6 is overcoated with the overcoat solution composition from Example 5 The coating composition is applied using a Tsukiage dip coating apparatus and dried at 125° C. for 40 minutes. The result is an imaging member having an overcoating layer thickness of from about 2.5 to about 3.0 microns.

Comparative Example 9

Preparation of Non-Overcoated Imaging Member

An imaging member is made in the same manner as in Example 6, except that the overcoating layer is omitted.

Example 10

Testing of Imaging Members

The drums of Example 7 and 8 and Comparative Example 9 are mounted in an electrostatographic imaging scanner., a device well known in the industry and equipped with means to rotate the drum while it is electrically charged and discharged. The charge on the sample is monitored through use of electrostatic probes placed at precise positions around the circumference of the device. The samples in this Example are charged to a negative potential of 500 Volts. As the device rotates, the initial charging potential is measured by voltage probe 1. The sample is then exposed to monochromatic radiation of known intensity, and the surface potential measured by voltage probes 2 and 3. Finally, the sample is exposed to an erase lamp of appropriate intensity and wavelength and any residual potential is measure by voltage probe 4. The process is repeated under the control of the scanner's computer, and the data is stored in the computer. The PIDC (photo induced discharge curve) is obtained by plotting the potentials at voltage probes 2 and 3 as a function of the light energy. The samples' dark decay and charge acceptance are also determined from the scanner data.

The PIDCs are measured under three different environmental conditions, e.g. A-zone (80° F., 85% humidity), B-zone (72° F., 50% humidity), and C-zone (15° F., 52% humidity). The results show that there is no significant difference between the overcoated drums of Example 7 and 8 and the non-overcoated drums of Comparative Example 9.

The overcoated drums of Example 7 and 8 and the non-overcoated drum of Comparative Example 9 are also subjected to a long electrical cycling test in A-zone. The results show no CDS (charge deletion spots) or background issues found during the cycling test at 2 million cycles for the overcoated drum. Instead, the occurrence of CDS occurs sometime between about 2 and 2.3 million cycles. In contrast, for the non-overcoated drum, CDS and background problems occur after only 340 to 510 cycles.

Next, the imaging members of Example 7 and 8 and Comparative Example 9 were tested for abrasion resistance (wear rate) in a wear fixture that includes a bias charging roll for charging. Wear rate is calculated in terms of nanometers/kilocycles of rotation (nm/kc). The wear rate for the imaging member having no overcoat (Comparative Example 9) is about 75 to 85 nm/kc, as compared to the about 10 to 15 nm/kc wear rate of the imaging member having an overcoat of either polyester or acrylic polyol (Example 7 and 8).

Lastly, the imaging members of Example 9 and Comparative Example 6 are tested for water repellency. The drums are placed in an A-zone chamber for 2 days. Afterwards, the imaging member is immediately printed with a XEROX® emulsion/aggregation toner composition in a loss of resolution test used to measure surface conductivity. The target image includes 1 bit and 2 bit lines and images with variations in black color intensity. The results show no indication of water absorption in the overcoat layers of Example 7and 8, indicating no added conductivity in the overcoat layer. Image quality of the printed image is excellent.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. an electrophotographic imaging member comprising:

a substrate, a charge generating layer, a charge transport layer, and an overcoating layer, said overcoating layer comprising a cured polyester polyol or cured acrylated polyol film forming resin and a charge transport material.

2. The electrophotographic imaging member of claim 1, wherein molecules of the polyester polyol before curing comprise multiple ester groups and multiple alcohol groups in the molecule.

3. The electrophotographic imaging member of claim 1, wherein molecules of the polyester polyol before curing further comprise ether groups.

4. The electrophotographic imaging member of claim 1, wherein the film forming resin is a branched polyester polyol.

5. The electrophotographic imaging member of claim 1, wherein the film forming resin is a polyester polyol represented by the formula:

$$-(-C-R_a-C)_m-(-CO_2-R_b-CO_2-)_n-(-C-R_c-C)_p-(-CO_2-R_d-CO_2-)_q$$

where Ra and Rc independently represent linear alkyl groups or branched alkyl groups derived from the polyols, the alkyl groups having from 1 to about 20 carbon atoms; Rb and Rd independently represent alkyl groups derived from the polycarboxylic acids, the alkyl groups having from 1 to about 20 carbon atoms; and m, n, p, and q represent mole fractions of from 0 to 1, such that n+m+p+q=1.

6. The electrophotographic imaging member of claim 1, wherein the film forming resin is a polyester polyol that before curing is a branched polyester bearing hydroxyl groups, having an acid value of ≦4 mg KOH/g, a hydroxyl content of about 8.6±0.3%, and an equivalent weight of about 200.

7. The electrophotographic imaging member of claim 1, wherein the film forming resin is a polyester polyol that before curing is a branched polyether/polyester having an acid value of ≦2 mg KOH/g, and a hydroxyl value of 300-330 mg KOH/g.

8. The electrophotographic imaging member of claim 1, wherein the film forming resin is a cured acrylated polyol.

9. The electrophotographic imaging member of claim 8, wherein the acrylated polyol is a branched acrylated polyol.

10. The electrophotographic imaging member of claim 8, wherein the acrylated polyol is represented by the formula:

$$[R_t-CH2-]_t-\{[-C-R_a-C]_m-[-CO-R_b-CO-]_n-[-C-R_c-C]_p-[-CO-R_d-CO-]_q\}$$

where $R_t$ represent $CH_2CR_1CO_2$— where $R_1$ is an alkyl group of from 1 to about 20 carbon atoms; t represents mole fractions of acrylated sites from 0 to 1; Ra and Rc independently represent linear alkyl or alkoxy groups or branched alkyl or alkoxy groups derived from the polyols, the alkyl and alkoxy groups having from 1 to about 20 carbon atoms; Rb and Rd independently represent alkyl or alkoxy groups, the alkyl and alkoxy groups having from 1 to about 20 carbon atoms; and m, n, p, and q represent mole fractions of from 0 to 1, such that n+m+p+q=1.

11. The electrophotographic imaging member of claim 1, wherein the overcoating layer is formed from a solution comprising said film forming resin and said charge transport material, in a solvent.

12. The electrophotographic imaging member of claim 11, wherein the solution further comprises at least one of a crosslinking accelerator and a catalyst.

13. The electrophotographic imaging member of claim 11, wherein the solution further comprises a melamine crosslinking accelerator and an acid catalyst.

14. The electrophotographic imaging member of claim 13, wherein the crosslinking accelerator is a methoxymethylated melamine compound.

15. The electrophotographic imaging member of claim 1, wherein the overcoating layer comprising from about 0 to about 60 percent by weight charge transport material and from about 100 to about 60 percent by weight film forming resin.

16. A process for forming an electrophotographic imaging member comprising:

providing an electrophotographic imaging member comprising a substrate, a charge generating layer, and a charge transport layer, and forming thereover an overcoating layer comprising a cured polyester polyol or cured acrylated polyol film forming resin and a charge transport material.

17. The process of claim 16, wherein the forming step comprises:

providing a solution comprising said film forming resin and said charge transport material, in a solvent;

coating said solution on said electrophotographic imaging member; and crosslinking said film forming resin to form a cured polymeric film.

18. The process of claim 16, wherein the film forming resin is a branched polyester polyol.

19. The process of claim 16, wherein the film forming resin is a polyester polyol represented by the formula:

$$-(-C-R_a-C)_m-(-CO_2-R_b-CO_2-)_n-(-C-R_c-C)_p-(-CO_2-R_d-CO_2-)_q$$

where Ra and Rc independently represent linear alkyl groups or branched alkyl groups derived from the polyols, the alkyl groups having from 1 to about 20 carbon atoms; Rb and Rd independently represent alkyl groups derived from the polycarboxylic acids, the alkyl groups having from 1 to about 20 carbon atoms; and m, n, p, and q represent mole fractions of from 0 to 1, such that n+m+p+q=1.

20. The process of claim 16, wherein the film forming resin is a polyester polyol that before curing is selected from the group consisting of:

a branched polyester bearing hydroxyl groups; having an acid value of ≦4 mg KOH/g, a hydroxyl content of about 8.6±0.3%, and an equivalent weight of about 200; and a branched polyether/polyester having an acid value of ≦2 mg KOH/g, and a hydroxyl value of 300-330 mg KOH/g.

21. The process of claim 16, wherein the film forming resin is a cured acrylated polyol represented by the formula:

$$[R_t-CH2-]_t-\{[-C-R_a-C]_m-[-CO-R_b-CO-]_n-[-C-R_c-C]_p-[-CO-R_d-CO-]_q\}$$

where $R_t$ represent $CH_2CR_1CO_2$— where $R_1$ is an alkyl group of from 1 to about 20 carbon atoms; t represents mole fractions of acrylated sites from 0 to 1; Ra and Rc independently represent linear alkyl or alkoxy groups or branched alkyl or alkoxy groups derived from the polyols, the alkyl and alkoxy groups having from 1 to about 20 carbon atoms; Rb and Rd independently represent alkyl or alkoxy groups, the alkyl and alkoxy groups having from 1 to about 20 carbon atoms; and m, n, p, and q represent mole fractions of from 0 to 1, such that n+m+p+q=1.

22. The process of claim 17, wherein the solution further comprises at least one of a crosslinking accelerator and a catalyst.

23. The process of claim 17, wherein the solution further comprises a melamine crosslinking accelerator and an acid catalyst.

24. The process of claim 23, wherein the crosslinking accelerator is a methoxymethylated melamine compound.

25. An electrographic image development device, comprising an electrophotographic imaging member comprising:

a substrate, a charge generating layer, a charge transport layer, and an overcoating layer, said overcoating layer comprising a cured polyester polyol or cured acrylated polyol film forming resin and a charge transport material.

* * * * *